US011325171B2

(12) United States Patent
Sung et al.

(10) Patent No.: US 11,325,171 B2
(45) Date of Patent: May 10, 2022

(54) APPARATUS OF MANUFACTURING PANEL FOR HOME APPLIANCE AND METHOD OF MANUFACTURING THE HOME APPLIANCE

(71) Applicant: Samsung Electronics Co., Ltd, Suwon-si (KR)

(72) Inventors: Do Soo Sung, Suwon-si (KR); Young Deog Koh, Seongnam-si (KR); Cheol Hee Cho, Gunpo-si (KR); Jin O Kwak, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 452 days.

(21) Appl. No.: 15/898,530

(22) Filed: Feb. 17, 2018

(65) Prior Publication Data

US 2018/0236513 A1 Aug. 23, 2018

(30) Foreign Application Priority Data

Feb. 17, 2017 (KR) ..... 10-2017-0021724

(51) Int. Cl.

| | |
|---|---|
| ***B21B 13/14*** | (2006.01) |
| ***B21B 31/02*** | (2006.01) |
| ***B21B 38/10*** | (2006.01) |
| ***B21B 13/02*** | (2006.01) |
| ***B24B 7/12*** | (2006.01) |
| ***B24B 21/00*** | (2006.01) |
| ***B24B 27/00*** | (2006.01) |

(Continued)

(52) U.S. Cl.

CPC ..... *B21B 13/14* (2013.01); *B21B 13/02* (2013.01); *B21B 31/02* (2013.01); *B21B 38/10* (2013.01); *B24B 7/12* (2013.01); *B24B 21/008* (2013.01); *B24B 21/14* (2013.01); *B24B 27/0023* (2013.01); *B24B 21/06* (2013.01)

(58) Field of Classification Search

CPC ... B24B 21/006; B24B 21/008; B24B 21/025; B24B 21/04; B24B 21/12; B24B 21/14; B24B 21/16; B24B 21/20; B21B 13/02; B21B 13/14; B21B 39/082

USPC ..... 451/300, 303

See application file for complete search history.

(56) References Cited

U.S. PATENT DOCUMENTS 1,998,770 A * 4/1935 Schulte ..... B24B 21/12 451/28
2,162,279 A * 6/1939 Herchenrider ..... B24B 21/14 451/301

(Continued)

FOREIGN PATENT DOCUMENTS

DE 1652073 A1 * 10/1970 ..... B24B 21/16
JP WO2009110395 A1 7/2011

(Continued)

*Primary Examiner* — Adam J Eiseman
*Assistant Examiner* — Stephen Floyd London

(57) ABSTRACT

Disclosed herein are an apparatus of manufacturing a panel for home appliance by performing uniform surface processing on the panel and a method of manufacturing a home appliance by performing uniform surface processing on a panel. The apparatus of manufacturing a panel for home appliance includes a contacting roller configured to perform surface-processing on a panel that is to be processed; a pressing roller configured to press the panel toward the contacting roller; and a supporting roller configured to support a center middle portion of the contacting roller.

10 Claims, 14 Drawing Sheets

(51) Int. Cl.
*B24B 21/14* (2006.01)
*B24B 21/06* (2006.01)

(56) References Cited

U.S. PATENT DOCUMENTS 3,269,065 A * 8/1966 Nylund ..... B24B 21/04 451/59
3,524,284 A * 8/1970 Mears ..... B24B 21/00 451/303
3,596,489 A * 8/1971 Ball ..... B21B 13/147 72/241.6
3,832,808 A * 9/1974 Kiser ..... B24B 21/12 451/300
3,872,627 A * 3/1975 Schuster ..... B24B 21/08 451/296
3,915,290 A * 10/1975 Zuercher ..... B65G 37/005 198/626.6
4,270,377 A * 6/1981 Verbickas ..... B21B 13/145 72/243.4
4,322,919 A * 4/1982 Gerber ..... B24B 7/12 198/782
4,487,050 A * 12/1984 Kajiwara ..... B21B 13/147 72/241.8
4,594,815 A * 6/1986 Mickelson ..... B24B 21/04 144/247
4,742,650 A * 5/1988 Sauder, Jr. ..... B24B 21/06 451/300
5,220,750 A * 6/1993 Emberland ..... B24B 21/10 451/300
8,365,567 B2 2/2013 Ogawa et al.
2001/0011001 A1* 8/2001 Lienard ..... B24B 5/18 451/49
2003/0022602 A1* 1/2003 McCoy ..... B24B 21/025 451/49
2010/0081006 A1* 4/2010 Leidolf, Jr. ..... C22C 38/04 428/687
2010/0206464 A1 8/2010 Heo et al.
2011/0023572 A1* 2/2011 Norikura ..... B21B 13/145 72/224
2011/0067474 A1* 3/2011 Tazoe ..... B21C 47/00 72/200
2016/0325395 A1* 11/2016 von Schumann ..... B24B 21/14

FOREIGN PATENT DOCUMENTS

KR 1989-0005481 A 5/1989
KR 10-2007-0011643 A 1/2007
KR 10-2008-0026327 A 3/2008
KR 10-2008-0035094 A 4/2008
KR 10-0860645 B1 9/2008
KR 10-2009-0006301 A 1/2009
KR 20-2011-0006544 U 6/2011
KR 10-1573371 B1 12/2015

* cited by examiner

—Prior Art—

—Prior Art—

—Prior Art—

APPARATUS OF MANUFACTURING PANEL FOR HOME APPLIANCE AND METHOD OF MANUFACTURING THE HOME APPLIANCE

CROSS-REFERENCE TO RELATED APPLICATION

This application is based on and claims priority under 35 U.S.C. § 119 to Korean Patent Application No. 10-2017-0021724, filed on Feb. 17, 2017, in the Korean Intellectual Property Office, the disclosure of which is incorporated by reference herein in its entirety.

TECHNICAL FIELD

The present disclosure relates to an apparatus of manufacturing a panel for home appliance, and a method of manufacturing the home appliance, and more particularly, to an apparatus of manufacturing a surface-processed panel for home appliance, and a method of surface-processing a panel.

BACKGROUND

The interiors or exteriors of home appliances, such as a refrigerator, a washing machine, and an air conditioner, are manufactured using panels made of various materials including a metal and plastic. When a metal panel is used in the interior or exterior of a home appliance, the metal panel is made of a material selected appropriately according to the purpose of use. For example, at least one material among aluminum, steel, zinc, tin, copper, and stainless steel can be used to manufacture metal panels.

Recently, various patterns and textures are formed on the surfaces of panels through surface-processing for a beautiful exterior and interior of a home appliance. Generally, if a metal panel is surface-processed, dazzling caused by luster on the metal panel can be prevented, and the outer appearance of a home appliance can look luxurious.

Surface-processing methods include a polishing method of forming scratch patterns of relatively short lengths on the surface of a panel, and a hair-line processing method of forming hair-line textures of relatively long lengths on the surface of a panel. In the polishing method and the hair-line processing method, it is preferable that the scratch patterns and the hair-line textures are formed with a uniform density and thickness such that the surface of the panel is not mottled and no chattering mark is formed on the surface of the panel.

SUMMARY

Therefore, it is an aspect of the present disclosure to provide an apparatus of manufacturing a panel for home appliance by performing uniform surface processing on the panel.

It is another aspect of the present disclosure to provide a method of manufacturing a home appliance by performing uniform surface processing on a panel.

Additional aspects of the disclosure will be set forth in part in the description which follows and, in part, will be obvious from the description, or may be learned by practice of the disclosure.

In accordance with an aspect of the present disclosure, an apparatus of manufacturing a panel for home appliance may include a contacting roller configured to perform surface-processing on a panel that is to be processed; a pressing roller configured to press the panel toward the contacting roller; and a supporting roller configured to support a middle portion of the contacting roller.

The apparatus of manufacturing a panel may further include a plurality of supporting rollers, and the plurality of supporting rollers are arranged at regular intervals above the contacting roller.

The apparatus of manufacturing a panel may further include a receiving roller disposed between the contacting roller and the supporting roller.

The apparatus of manufacturing a panel may further include a plurality of receiving rollers.

A length of the receiving roller may be longer than or equal to a length of the contacting roller.

The supporting roller may have a length that is shorter than a length of the contacting roller, and is disposed at a center of the contacting roller.

The pressing roller may be disposed below the contacting roller, and presses the panel upward.

The pressing roller may press the panel when the panel arrives at a position between the contacting roller and the pressing roller, and may release the pressure applied on the panel before the panel escapes from between the contacting roller and the pressing roller.

The apparatus of manufacturing a panel may further include a pinching apparatus disposed in front of and behind the contacting roller and the pressing roller, and configured to pinch the panel. The pinching apparatus may include an upper pinching roller disposed above the panel, and a lower pinching roller disposed below the panel. The pinching apparatus may pinch the panel when the panel arrives at a position between the upper pinching roller and the lower pinching roller, and may release the pinching of the panel before the panel escapes from between the upper pinching roller and the lower pinching roller.

The pinching apparatus may include a plurality of upper pinching rollers, and a plurality of lower pinching rollers corresponding to the plurality of upper pinching rollers.

In accordance with an aspect of the present disclosure, a method of manufacturing a home appliance may include supplying a panel that is to be processed; at a first pinching apparatus, pinching the panel when the panel arrives at a position between a first upper pinching roller and a first lower pinching roller; at a pressing roller, pressing the panel toward a contacting roller when the panel arrives at a position between the contacting roller and the pressing roller; at a supporting roller, supporting the contacting roller such that the contacting roller applies pressure uniformly on the panel; and at the contacting roller, performing surface-processing on the panel.

The method may further include releasing the pinching of the panel before the panel escapes from between the first upper pinching roller and the first lower pinching roller.

The method may further include, at the pressing roller, releasing the pressing of the panel before the panel escapes from between the contacting roller and the pressing roller.

The method may further include pinching the panel when the surface-processed panel arrives at a position between a second upper pinching roller and a second lower pinching roller.

The method may further include releasing the pinching of the panel before the surface-processed panel escapes from between the second upper pinching roller and the second lower pinching roller.

In accordance with an aspect of the present disclosure, an apparatus of manufacturing a panel for home appliance may include a hair-line processing apparatus having a hair-line processing head. The hair-line processing head may include a contacting roller configured to engrave a hair-line texture on a panel that is to be processed, and a pressing roller configured to press the panel toward the contacting roller. The pressing roller may press the panel when the panel arrives at a position between the contacting roller and the pressing roller, and may release the pressure applied on the panel before the panel escapes from between the contacting roller and the pressing roller.

The hair-line processing apparatus may further include a pinching apparatus disposed in front of and behind the hair-line processing head, and configured to pinch the panel. The pinching apparatus may include at least one upper pinching roller disposed above the panel, and at least one lower pinching roller disposed below the panel and corresponding to the upper pinching roller. The pinching apparatus may pinch the panel when the panel arrives at a position between the upper pinching roller and the lower pinching roller, and may release the pinching of the panel before the panel escapes from between the upper pinching roller and the lower pinching roller.

The hair-line processing apparatus may include a plurality of hair-line processing heads.

The apparatus of manufacturing a panel may further include a polishing apparatus having a polishing head, and a pinching apparatus disposed in front of and behind the polishing head.

The apparatus of manufacturing a panel may further include a plurality of polishing apparatuses.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
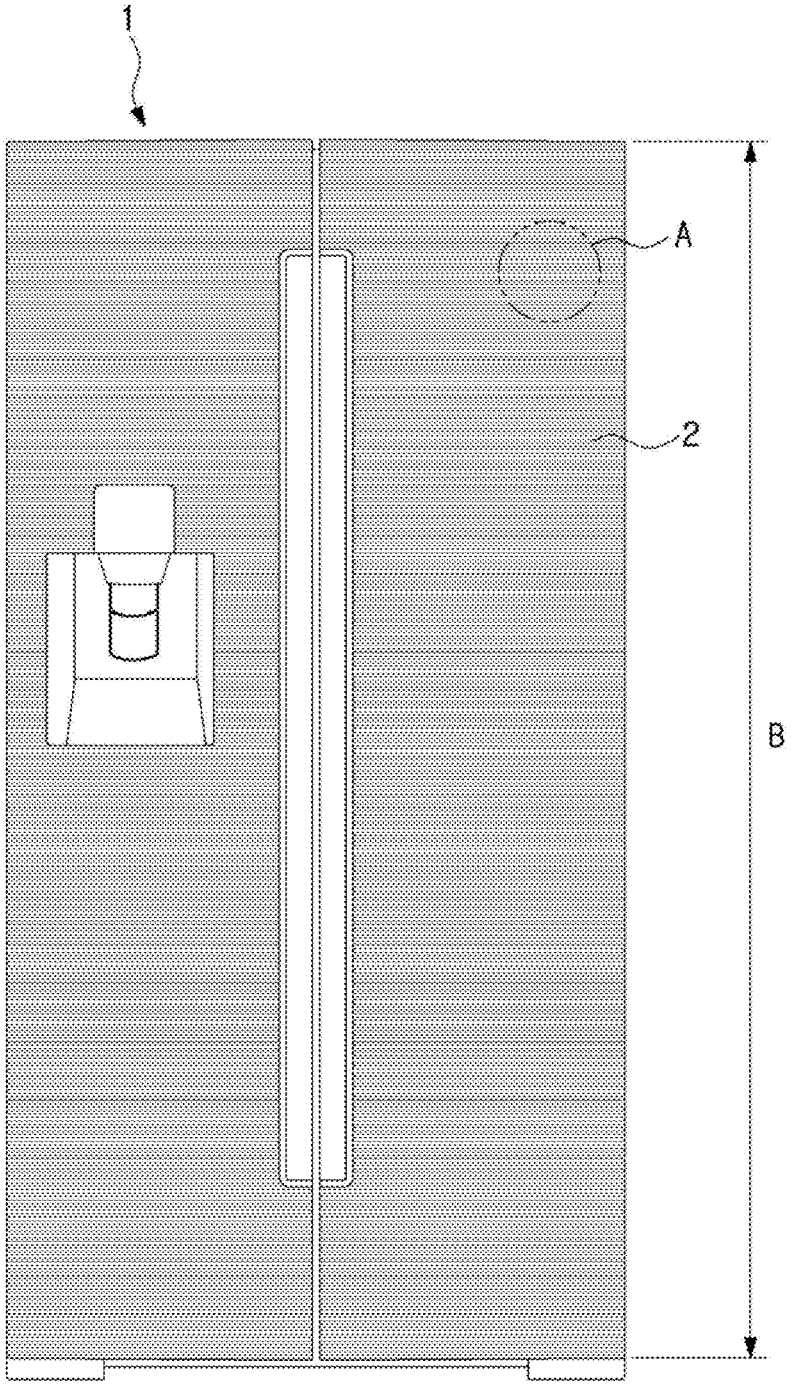
FIG. 1 shows a front portion of a home appliance including a panel manufactured by an apparatus of manufacturing a panel for home appliance, according to an embodiment of the present disclosure.

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

The terms used in the present specification are used to describe the embodiments of the present disclosure. Accordingly, it should be apparent to those skilled in the art that the following description of exemplary embodiments of the present invention is provided for illustration purpose only and not for the purpose of limiting the invention as defined by the appended claims and their equivalents. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, components, or combination thereof, but do not preclude the presence or addition of one or more other features, figures, steps, components, members, or combinations thereof.

It will be understood that, although the terms first, second, etc. may be used herein to describe various components, these components should not be limited by these terms. These terms are only used to distinguish one component from another. For example, a first component could be termed a second component, and, similarly, a second component could be termed a first component, without departing from the scope of the present disclosure.

Hereinafter, the embodiments of the present disclosure will be described in detail with reference to the accompanying drawings.

Figure 2:
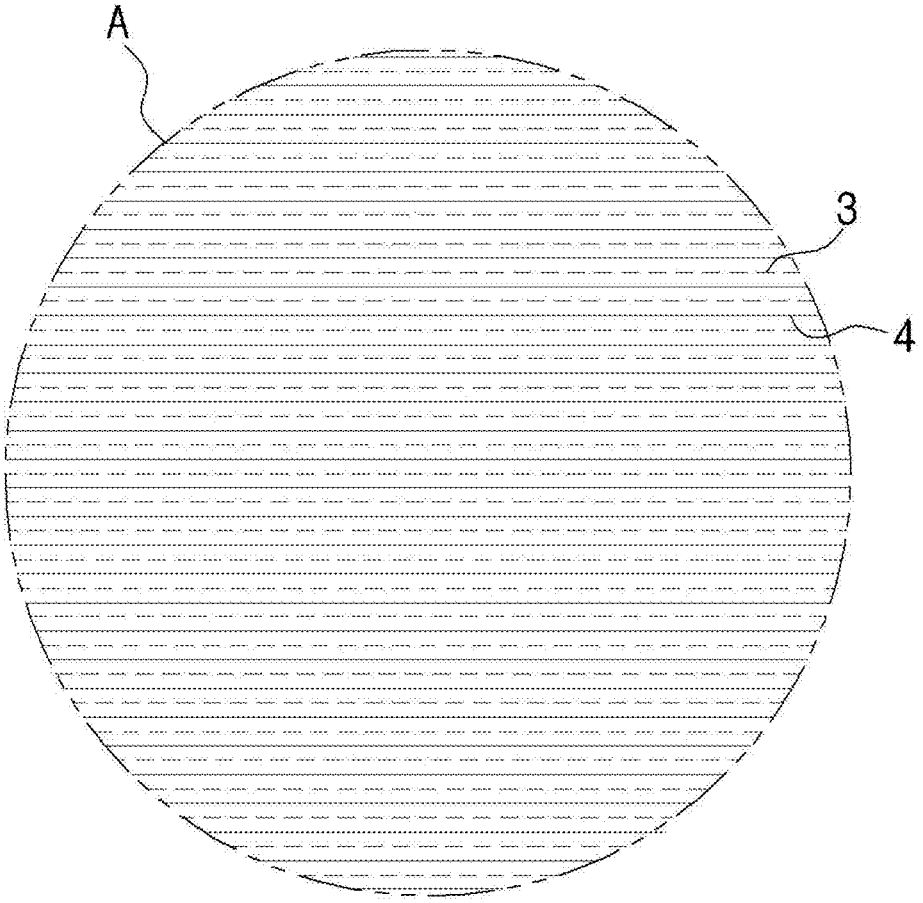
FIG. 2 is an enlarged view of an area A of FIG. 1.

FIG. 1 shows a front portion of a home appliance including a panel manufactured by an apparatus of manufacturing a panel for home appliance, according to an embodiment of the present disclosure, and FIG. 2 is an enlarged view of an area A of FIG. 1.

The home appliance may be one of various products used in home, such as a refrigerator, a washing machine, an air conditioner, and a television. In FIG. 1, a refrigerator 1 is shown as an example of the home appliance.

Referring to FIG. 1, the refrigerator 1 may be a side-by-side type in which storage rooms are divided into left and right rooms. However, the refrigerator 1 may be a built-in type having a single door, although not shown in the drawings.

A panel 2 for home appliance subject to surface-processing by the apparatus of manufacturing the panel for home appliance or the apparatus of manufacturing the home appliance, according to the present disclosure, may be used in an interior or exterior of the refrigerator 1. More specifically, the panel 2 for home appliance may be used in an outer surface of the refrigerator 1 or in outer surfaces of doors of the refrigerator 1, and also used in inner surfaces of the refrigerator 1, that is, in side surfaces of the storage room or inner surfaces of the doors.

The panel 2 for home appliance may be made of various materials, such as a metal, plastic, etc. For example, the panel 2 for home appliance may be made of a metal material including at least one among aluminum, steel, zinc, tin, copper, and stainless steel.

The panel 2 for home appliance may be subject to surface-processing for forming various patterns or textures on the surface, in order to improve the quality of the outer appearance. Surface-processing methods include a polishing method of forming patterns of relatively short scratches on the surface of a panel, and a hair-line processing method of forming textures of relatively long hair lines on the surface of a panel.

In the polishing method and the hair-line processing method, it is preferable that the scratch patterns and the hair-line textures are formed with a uniform density and thickness. Also, it is preferable that no chattering mark is formed on the surface of the panel. If the scratch patterns and the hair-line textures are non-uniformly formed, the surface of the panel may be mottled, or undesired patterns may be formed on the surface of the panel.

Referring to FIGS. 1 and 2, the panel 2 for home appliance may include scratch patterns 3 formed horizontally and hair line textures 4 formed horizontally. If the scratch patterns 3 and the hair line textures 4 are formed horizontally on the panel 2 made of stainless steel, the panel 2 may have metallic luster and textures.

Generally, a side-by-side type refrigerator and a built-in type refrigerator may include a long vertical door. The refrigerator 1 may include a door having a height B of 1300 mm or longer. The apparatus of manufacturing the panel 2 for home appliance or the method of manufacturing the home appliance, according to the present disclosure, may form the scratch patterns 3 and the hair line textures 4 with a uniform density and thickness, horizontally, on the panel 2 for home appliance having the height B of 1300 mm or longer.

Figure 3:
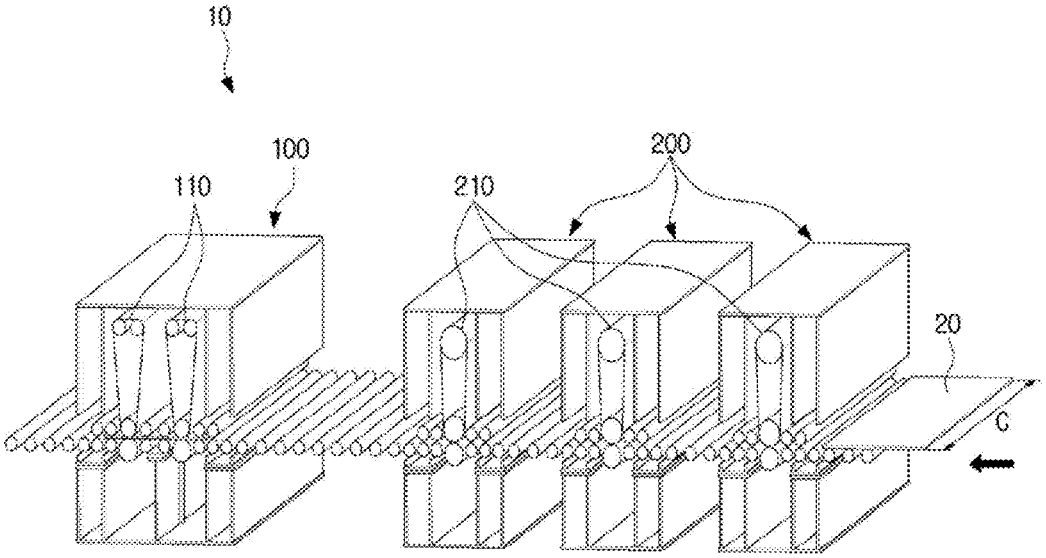
FIG. 3 shows an apparatus of manufacturing a panel for home appliance according to an embodiment of the present disclosure.

FIG. 3 shows an apparatus of manufacturing a panel for home appliance according to an embodiment of the present disclosure.

Referring to FIG. 3, an apparatus 10 of manufacturing a panel for home appliance may include a polishing apparatus 200 and a hair-line processing apparatus 100 to surface-process a panel 20 that is to be processed. The polishing apparatus 200 may include a polishing head 210 to form the scratch patterns 3 on the panel 20 that is to be processed. The hair-line processing apparatus 100 may include a hair-line processing head 110 to form the hair-line textures 4 on the panel 20 that is to be processed.

The apparatus 10 for manufacturing the panel for home appliance may surface-process the panel 20 having a long width C relative to the height. The width C of the panel 20 may be longer than the height B of the door of the refrigerator 1 shown in FIG. 1. The polishing head 210 of the polishing apparatus 200 and the hair-line processing head 110 of the hair-line processing apparatus 100 may have a width D (see FIG. 7) that is longer than the width C of the panel 20.

The apparatus 10 of manufacturing the panel for home appliance may include a plurality of polishing apparatuses 200. Since the polishing apparatus 200 needs to form scratches of short lengths on the panel 20, the polishing head 210 may rotate at high speed. Accordingly, each polishing apparatus 200 may include a polishing head 210 in consideration of safety and a processing method.

The hair-line processing apparatus 100 may include a plurality of hair-line processing heads 110. The hair-line processing heads 110 may rotate at lower speed than the polishing head 210 to form textures of long hair lines on the panel 20.

The panel 20 that is to be processed may be inserted in a direction of an arrow into the apparatus 10 of manufacturing the panel for home appliance, as shown in FIG. 3. The panel 20 may be transferred by a panel conveying apparatus. The panel 20 inserted into the apparatus 10 of manufacturing the panel for home appliance may pass through the polishing apparatus 200, so that the surface of the panel 20 is polished. The panel 20 may pass through the plurality of polishing apparatuses 200. Thereafter, the surface of the polished panel 20 may be hair-line processed when the panel 20 passes through the hair-line processing apparatus 100. The panel 20 may pass through the plurality of polishing heads 210.

Although not shown in the drawings, the apparatus 10 of manufacturing the panel for home appliance may further include a washer for washing the panel 20, and a drier for drying the washed panel 20, after the hair-line processing apparatus 100. Also, the apparatus 10 of manufacturing the panel for home appliance may further include a loader to load the panel 20 on the panel conveying apparatus, and an unloader to unload the processed panel 20 from the panel conveying apparatus.

Figure 4:
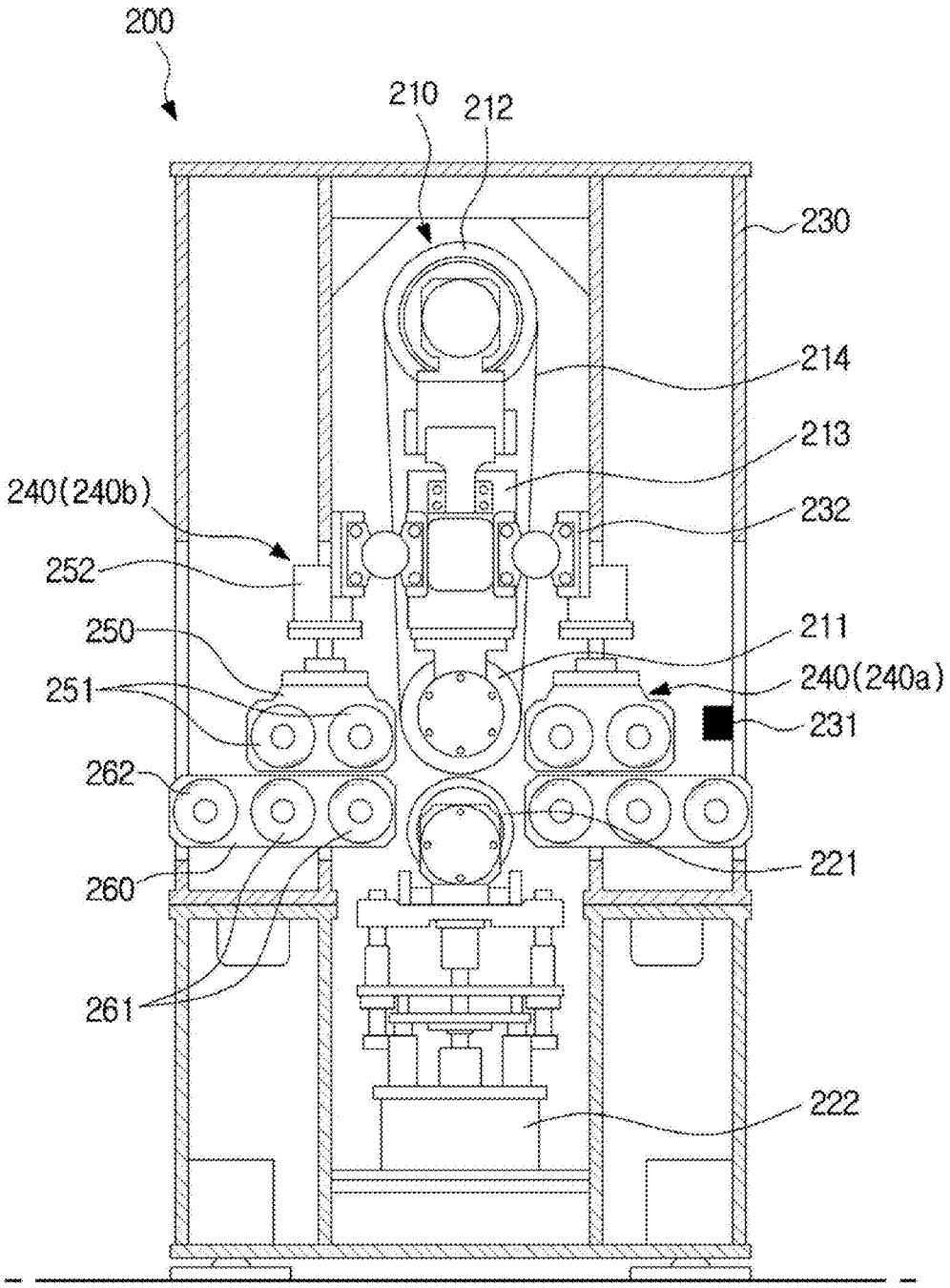
FIG. 4 shows a polishing apparatus shown in FIG. 3.

FIG. 4 shows a polishing apparatus shown in FIG. 3.

Referring to FIG. 4, the polishing apparatus 200 may include the polishing head 210 and a housing 230 on which the polishing head 210 is supported. The polishing head 210 may be supported on the housing 230 by a clamping apparatus 232. The clamping apparatus 232 may prevent the polishing head 210 rotating at high speed from vibrating.

The polishing head 210 may include a belt 214 having a rough surface to form the scratch patterns 3 on the panel 20, and a contacting roller 211 to make the belt 214 contact the panel 20 to engrave the scratch patterns 3 on the panel 20. The polishing head 210 may include a tensioning roller 212 to maintain a tension of the belt 214, and a tensioning cylinder 213 to maintain spacing between the contacting roller 211 and the tensioning roller 212.

The polishing apparatus 200 may include a pressing roller 221 to press the panel 20 toward the contacting roller 211, and a pressing cylinder 222 to drive the pressing roller 221. The pressing roller 221 and the pressing cylinder 222 may be disposed below the polishing head 210. The pressing cylinder 222 may apply a force to the pressing roller 221 such that the pressing roller 221 presses the panel 20 upward.

The polishing apparatus 200 may include a pinching apparatus 240 to locate the panel 20, and to prevent the panel 20 from vibrating. The polishing apparatus 200 may include a first pinching apparatus 240*a* disposed in front of the polishing head 210, and a second pinching apparatus 240*b* disposed behind the polishing head 210.

The pinching apparatus 240 may include a support 260 to support the panel 20, and a presser 250 to press the panel 20. The support 260 may support the panel 20 from below the panel 20, and the presser 250 may press the panel 20 from above the panel 20. The pinching apparatus 240 may include a pinching cylinder 252 to apply a force to the presser 250 toward the support 260.

The presser 250 may include an upper pinching roller 251, and the support 260 may include a lower pinching roller 261. The support 260 may include a conveying roller 262 to support and convey the panel 20, before the panel 20 enters between the upper pinching roller 251 and the lower pinching roller 261, or after the panel 20 escapes from between the upper pinching roller 251 and the lower pinching roller 261.

The pinching apparatus 240 may include a plurality of upper pinching rollers 251, and a plurality of lower pinching rollers 261 corresponding to the plurality of upper pinching rollers 251. The presser 250 may include the plurality of upper pinching rollers 251, and the support 260 may include the plurality of lower pinching rollers 261 corresponding to the plurality of upper pinching rollers 251.

The polishing apparatus 200 may include a sensor 231 to detect a position of the panel 20. The sensor 231 may be disposed at an entrance of the polishing apparatus 200, in order to determine whether the panel 20 enters the polishing apparatus 200.

When the panel 20 enters between the contacting roller 211 and the pressing roller 221 located close to each other in advance or between the upper pinching roller 251 and the lower pinching roller 261 located close to each other in advance, a repulsive force may be applied in an undesired direction to the panel 20. Also, when the panel 20 escapes from between the contacting roller 211 and the pressing roller 221 or from between the upper pinching roller 251 and the lower pinching roller 261 in the state in which a force is applied to the panel 20, the panel 20 may vibrate.

Accordingly, the pressing roller 221 may press the panel 20 when the panel 20 arrives at a position between the contacting roller 211 and the pressing roller 221, and release the pressure applied on the panel 20 before the panel 20 escapes from between the contacting roller 211 and the pressing roller 221.

The pinching apparatus 240 may pinch the panel 20 when the panel 20 arrives at a position between the upper pinching roller 251 and the lower pinching roller 261, and release the pinching of the panel 20 before the panel 20 escapes from between the upper pinching roller 251 and the lower pinching roller 261.

Figure 5:
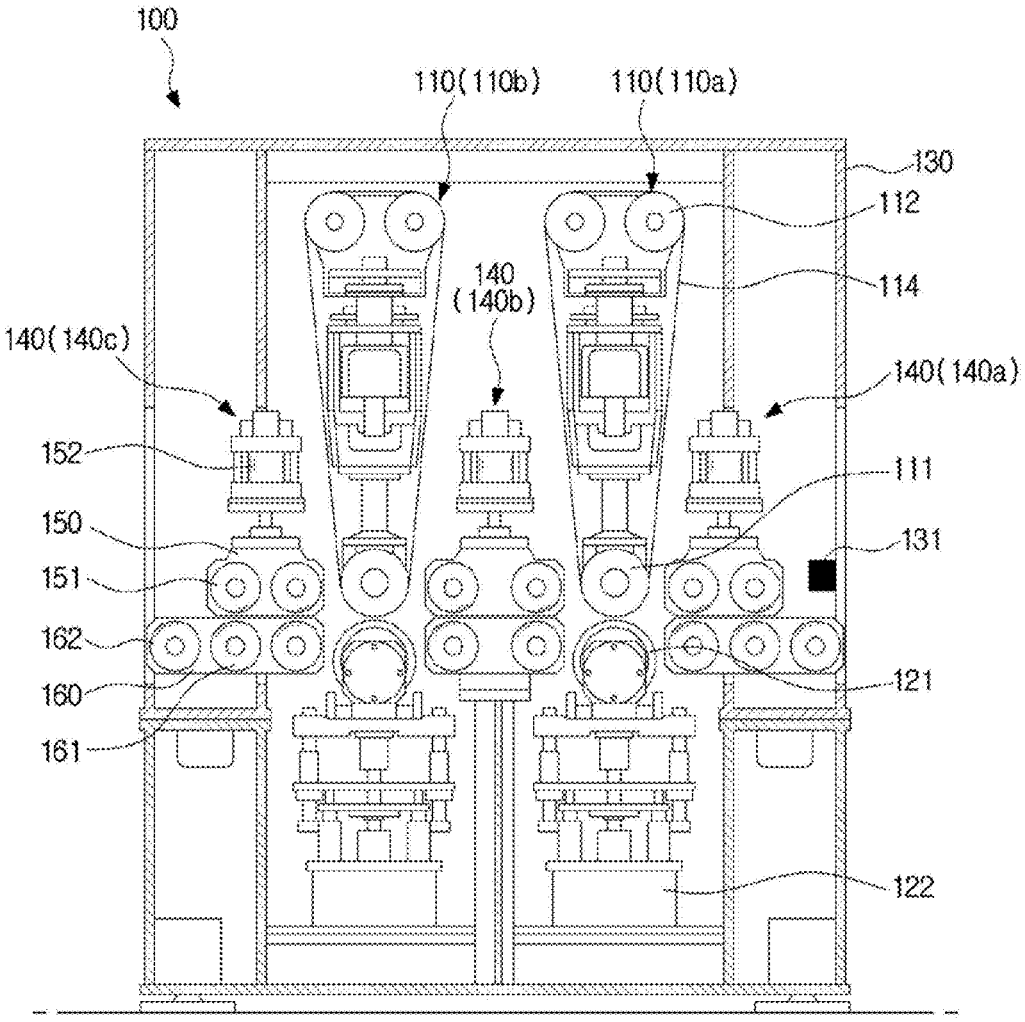
FIG. 5 shows a hair-line processing apparatus shown in FIG. 3.

FIG. 5 shows a hair-line processing apparatus shown in FIG. 3.

Referring to FIG. 5, the hair-line processing apparatus 100 may include a housing 130, and the hair-line processing head 110 disposed in the inside of the housing 130. The hair-line processing apparatus 100 may include the plurality of hair-line processing heads 110. The plurality of hair-line processing heads 110 may include a first hair-line processing head 110*a* and a second hair-line processing head 110*b* according to the processing order of the panel 20.

The hair-line processing head 110 may include a belt 114 having a rough surface to form hair-line textures on the panel 20, and a contacting roller 111 to make the belt 114 contact the panel 20 to engrave hair-line textures on the panel 20. The hair-line processing head 110 may include a tensioning roller 112 to maintain a tension of the belt 114, and a tensioning cylinder 113 to maintain spacing between the contacting roller 111 and the tensioning roller 112.

The hair-line processing apparatus 100 may include a pressing roller 121 to press the panel 20 toward the contacting roller 111, and a pressing cylinder 122 to drive the pressing roller 121. The pressing roller 121 and the pressing cylinder 122 may be disposed below the hair-line processing head 110. The pressing cylinder 122 may apply an upward force to the pressing roller 121 such that the pressing roller 121 can press the panel 20 upward.

The hair-line processing apparatus 100 may include a pinching apparatus 140 to locate the panel 20, and to prevent the panel 20 from vibrating. The pinching apparatus 140 may be disposed in front of and behind the contacting roller 111 and the pressing roller 121 to pinch the panel 20. The pinching apparatus 140 may include an upper pinching roller 151 disposed above the panel 20, and a lower pinching roller 161 disposed below the panel 20.

The hair-line processing apparatus 100 may include a plurality of pinching apparatuses 140. The plurality of pinching apparatuses 140 may include a first pinching apparatus 140*a* disposed in front of the first hair-line processing head 110*a*, a second pinching apparatus 140*b* disposed between the first hair-line processing head 110*a* and the second hair-line processing head 110*b*, and a third pinching apparatus 140*c* disposed behind the second hair-line processing head 110*b*.

The pinching apparatus 140 may include a support 160 to support the panel 20, and a presser 150 to press the panel 20. The support 160 may support the panel 20 from below the panel 20, and the presser 150 may press the panel 20 from above the panel 20. The pinching apparatus 140 may include a pinching cylinder 152 to apply a force to the presser 150 toward the support 160.

The presser 150 may include the upper pinching roller 151, and the support 160 may include the lower pinching roller 161. The support 160 may include a conveying roller 162 to support and convey the panel 20, before the panel 20 enters between the upper pinching roller 151 and the lower pinching roller 161, or after the panel 20 escapes from between the upper pinching roller 151 and the lower pinching roller 161.

The pinching apparatus 140 may include a plurality of upper pinching rollers 151, and a plurality of lower pinching rollers 161 corresponding to the plurality of upper pinching rollers 151. The presser 150 may include the plurality of upper pinching rollers 151, and the support 160 may include the plurality of lower pinching rollers 161 corresponding to the plurality of upper pinching rollers 151.

The hair-line processing apparatus 100 may include a sensor 131 to detect a position of the panel 20. The sensor 131 may be disposed at an entrance of the hair-line processing apparatus 100, in order to determine whether the panel 20 enters the hair-line processing apparatus 100.

When the panel 20 enters between the contacting roller 111 and the pressing roller 121 located close to each other in advance or between the upper pinching roller 151 and the lower pinching roller 161 located close to each other in advance, a repulsive force may be applied in an undesired direction to the panel 20. Also, when the panel 20 escapes from between the contacting roller 111 and the pressing roller 121 or from between the upper pinching roller 151 and the lower pinching roller 161 in the state in which a force is applied to the panel 20, the panel 20 may vibrate.

Accordingly, the pressing roller 121 may press the panel 20 when the panel 20 arrives at a position between the contacting roller 111 and the pressing roller 121, and release the pressure applied on the panel 20 before the panel 20 escapes from between the contacting roller 111 and the pressing roller 121.

The pinching apparatus 140 may pinch the panel 20 when the panel 20 arrives at a position between the upper pinching roller 151 and the lower pinching roller 161, and release the pinching of the panel 20 before the panel 20 escapes from between the upper pinching roller 151 and the lower pinching roller 161.

Figure 6:
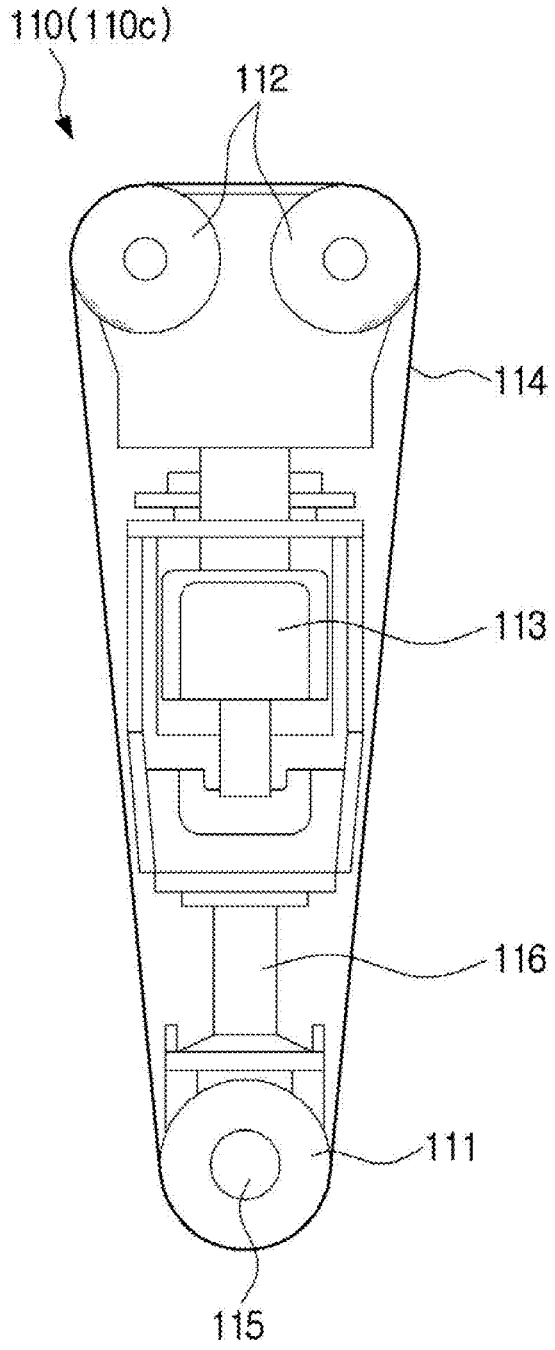
FIG. 6 shows a side of a typical hair-line processing head.
Figure 7:
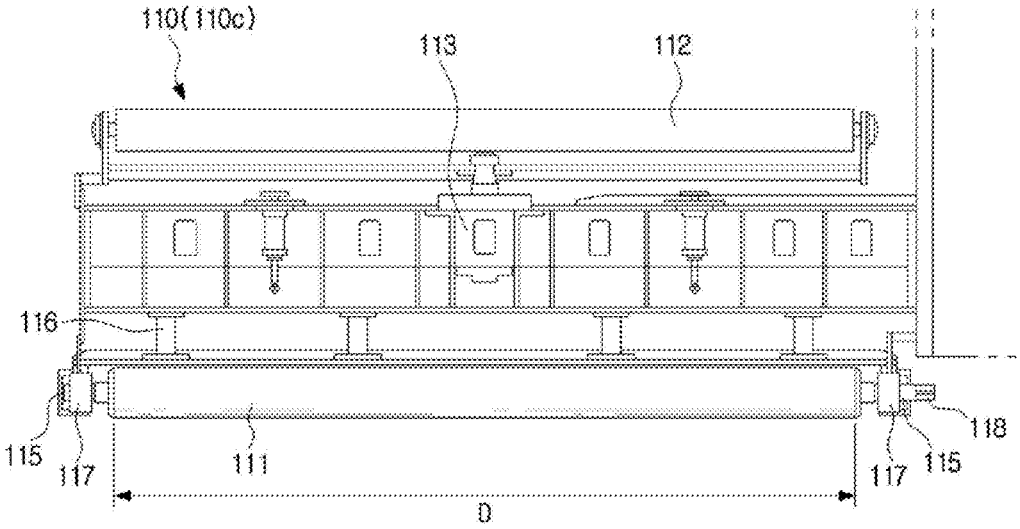
FIG. 7 shows a front portion of the hair-line processing head shown in FIG. 6.
Figure 8:
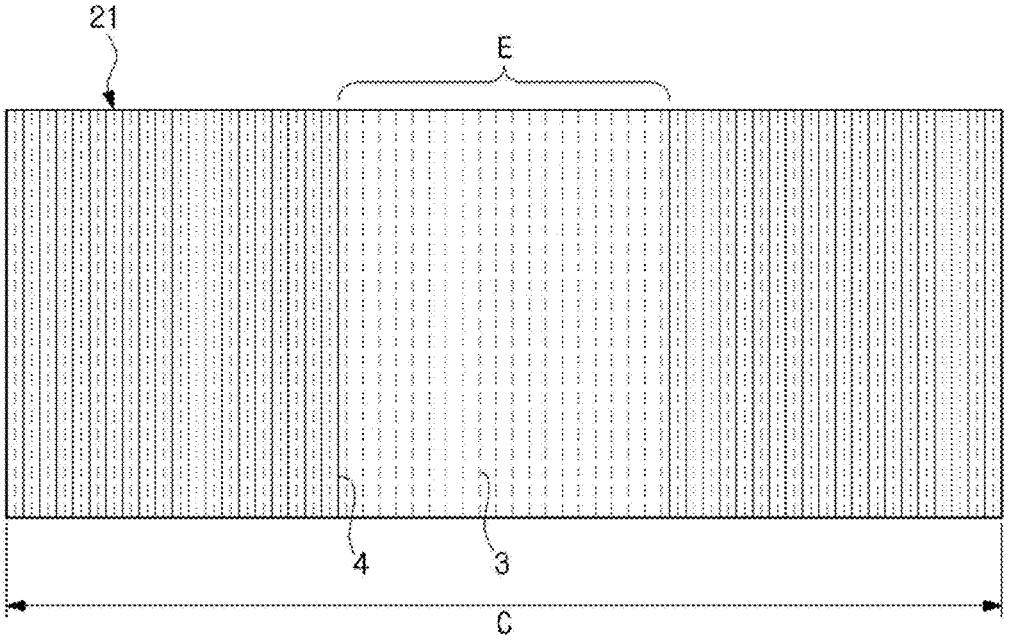
FIG. 8 shows a panel for home appliance manufactured by the typical hair-line processing head.

FIG. 6 shows a side of a typical hair-line processing head, FIG. 7 shows a front portion of the hair-line processing head shown in FIG. 6, and FIG. 8 shows a panel for home appliance manufactured by the typical hair-line processing head.

Referring to FIGS. 6 and 7, a typical hair-line processing head 110*c* may include a bracket 117 in which the contacting roller 111 is installed, and a connecting rod 116 connecting the tensioning cylinder 113 to the bracket 117. The bracket 117 may be supported on the tensioning cylinder 113 by a plurality of connecting rods 116. The contacting roller 111 may be connected to the bracket 117 such that both ends of a rotating shaft 115 are rotatable on the bracket 117. At one end of the rotating shaft 115 of the contacting roller 111, a driver connecting portion 118 may be provided.

The contacting roller 111 may need to have a length D that is longer than the width C of the panel 20. If the width C of the panel 20 increases, the length D of the contacting roller 111 may also need to increase accordingly.

The typical hair-line processing head 110*c* may support the contacting roller 111 only on both ends of the contacting roller 110. Therefore, when the pressing roller 121 is pressed upward, the middle portion of the contacting roller 111 cannot support the force from the pressing roller 121. More seriously, when the contacting roller 111 has a long length, the typical hair-line processing head 110*c* cannot support the contacting roller 111 uniformly. Accordingly, the contacting roller 111 cannot press the panel 20 uniformly, and thus cannot form hair-lines uniformly on the panel 20.

Referring to FIG. 8, a panel 21 processed by the typical hair-line processing head 110*c* may have a middle portion E on which no hair line texture is formed.

Figure 9:
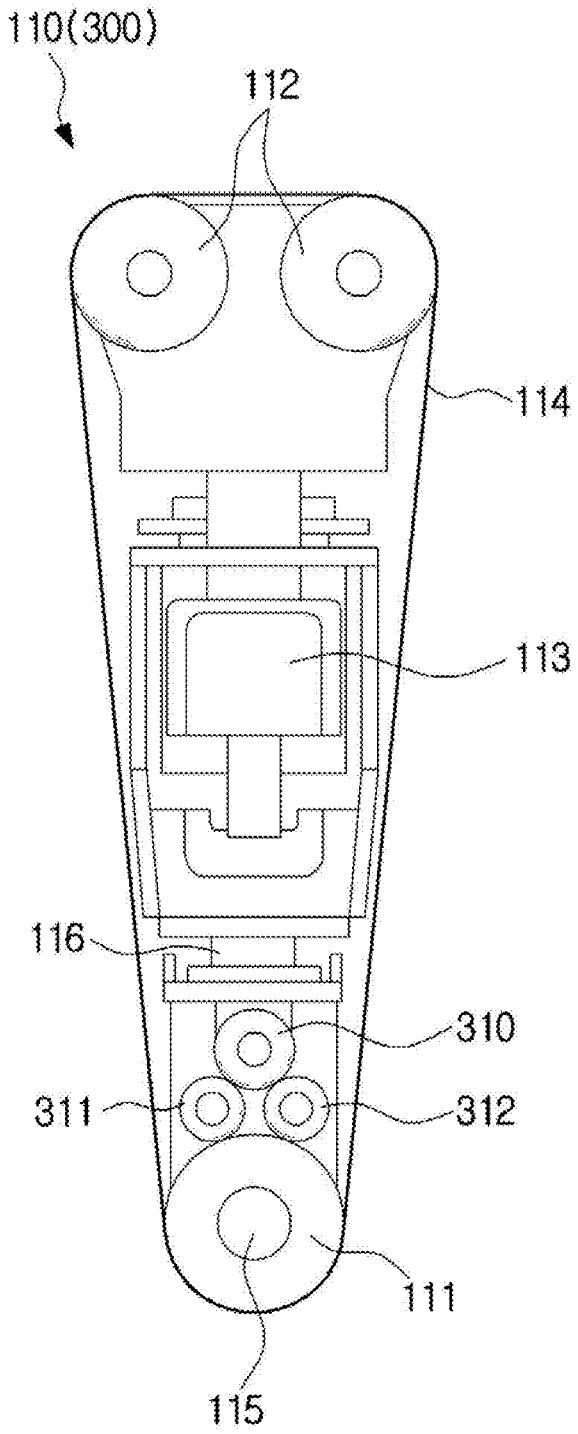
FIG. 9 shows a side of a hair-line processing head of an apparatus of manufacturing a panel for home appliance, according to an embodiment of the present disclosure.
Figure 10:
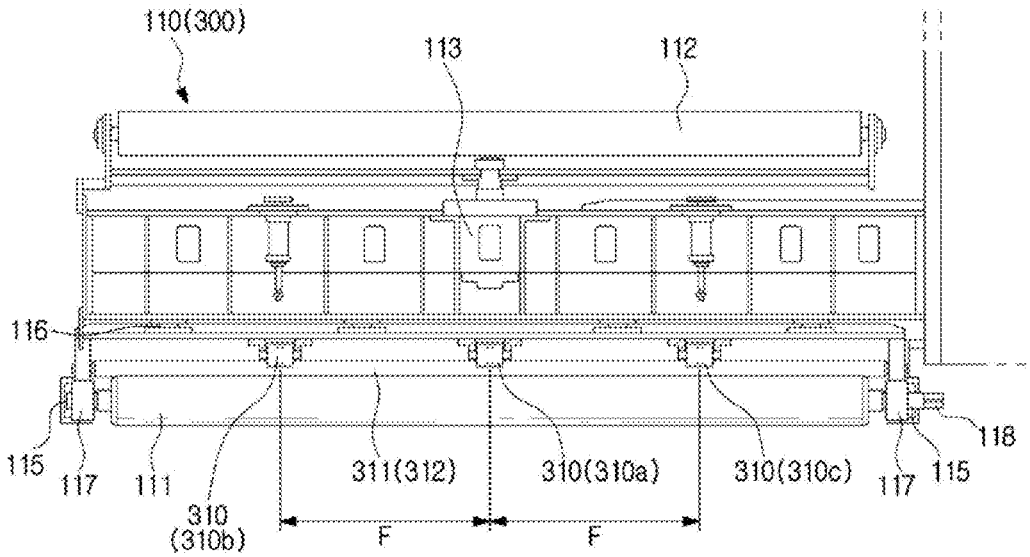
FIG. 10 shows a front portion of the hair-line processing head shown in FIG. 9.
Figure 11:
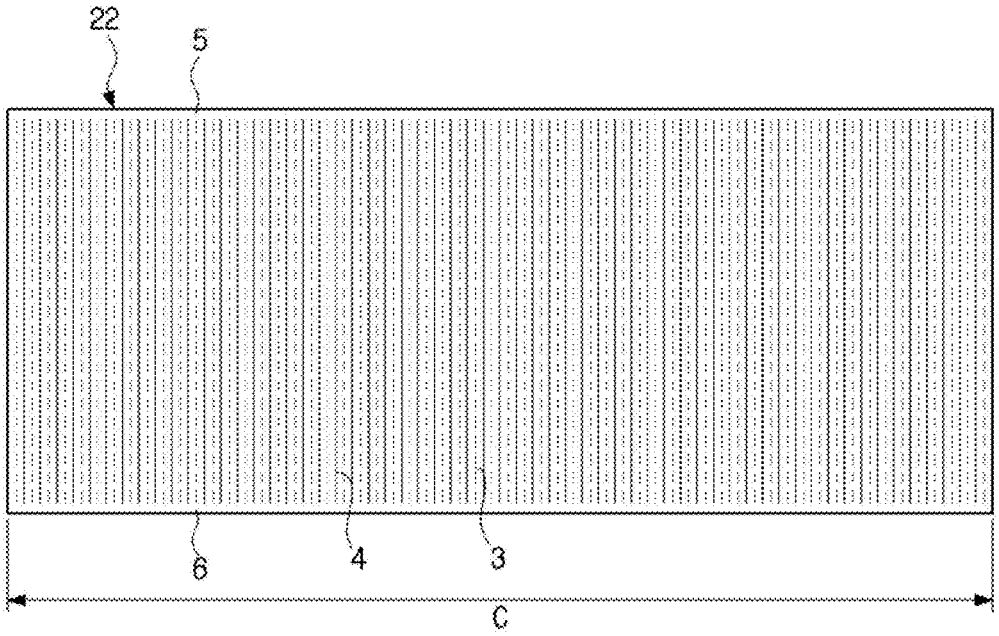
FIG. 11 shows a panel for home appliance manufactured by the apparatus of manufacturing the panel for home appliance, according to an embodiment of the present disclosure.

FIG. 9 shows a side of a hair-line processing head of an apparatus of manufacturing a panel for home appliance, according to an embodiment of the present disclosure, FIG. 10 shows a front portion of the hair-line processing head shown in FIG. 9, and FIG. 11 shows a panel for home appliance manufactured by the apparatus of manufacturing the panel for home appliance, according to an embodiment of the present disclosure.

Referring to FIGS. 9 and 10, a hair-line processing head 300 according to an embodiment of the present disclosure may include the bracket 117 in which the contacting roller 111 is installed, the connecting rod 116 connecting the tensioning cylinder 113 to the bracket 117, and a supporting roller 310 supporting the middle portion of the contacting roller 111. The supporting roller 310 may be supported on the bracket 117, and the bracket 117 may be supported on the tensioning cylinder 113 by the plurality of connecting rods 116. The contacting roller 111 may be connected to the bracket 117 such that both ends of the rotating shaft 115 are rotatable on the bracket 117. At one end of the rotating shaft 115 of the contacting roller 111, the driver connecting portion 118 may be provided.

The hair-line processing head 300 may include a plurality of supporting rollers. The plurality of supporting rollers may be arranged at regular intervals above the contacting roller 111. The plurality of supporting rollers may include a first supporting roller 310*a* disposed above the center of the contacting roller 111, a second supporting roller 310*b* disposed with spacing F from the first supporting roller 310*a*, and a third supporting roller 310*c*.

The hair-line processing head 300 may include a receiving roller disposed between the contacting roller 111 and the supporting roller 310. The hair-line processing head 300 may include a plurality of receiving rollers. The plurality of receiving rollers may include a first receiving roller 311 and a second receiving roller 312.

The receiving rollers 311 and 312 may be connected to the bracket 117 such that both ends of the receiving rollers 311 and 312 are rotatable on the bracket 117. The length of the receiving rollers 311 and 312 may be longer than or equal to the length D of the contacting roller 111. Accordingly, the supporting roller 310 can support the contacting roller 111 uniformly throughout the entire length of the contacting roller 111 by the receiving rollers 311 and 312.

If the hair-line processing head 300 includes the plurality of receiving rollers 311 and 312, the plurality of receiving rollers 311 and 312 may be disposed along a circumferential direction of the contacting roller 111, while contacting the contacting roller 111 and the supporting roller 310. If the plurality of receiving rollers 311 and 312 are disposed, the plurality of receiving rollers 311 and 312 can support the wide area of the contacting roller 111 more stably.

The contacting roller 111 of the hair-line processing head 300 may be connected to the bracket 117 at both ends of the rotating shaft 115. However, when the pressing roller 121 is pressed upward, the middle portion of the contacting roller 111 may be supported on the supporting roller 310. Accordingly, even when the contacting roller 111 has a long length D, the panel 20 can be pressed uniformly, and as a result, hair lines can be formed uniformly on the panel 20.

As shown in FIG. 11, hair-line textures 4 can be engraved uniformly throughout an entire width C of a panel 22 processed by the hair-line processing head 300 according to an embodiment of the present disclosure.

In the apparatus 10 of manufacturing the panel for home appliance and the method of manufacturing the home appliance, the pressing roller 121 may press the panel 20 when the panel 20 arrives at the position between the contacting roller 111 and the pressing roller 121, and may release the pressure applied on the panel before the panel 20 escapes from between the contacting roller 111 and the pressing roller 121. Accordingly, the panel 22 surface-processed by the apparatus 10 of manufacturing the panel for home appliance and the method of manufacturing the home appliance, according to an embodiment of the present disclosure, may include an upper end area 5 and a lower end area 6 on which neither the scratch patterns 3 nor the hair line textures 4 are formed.

Figure 12:
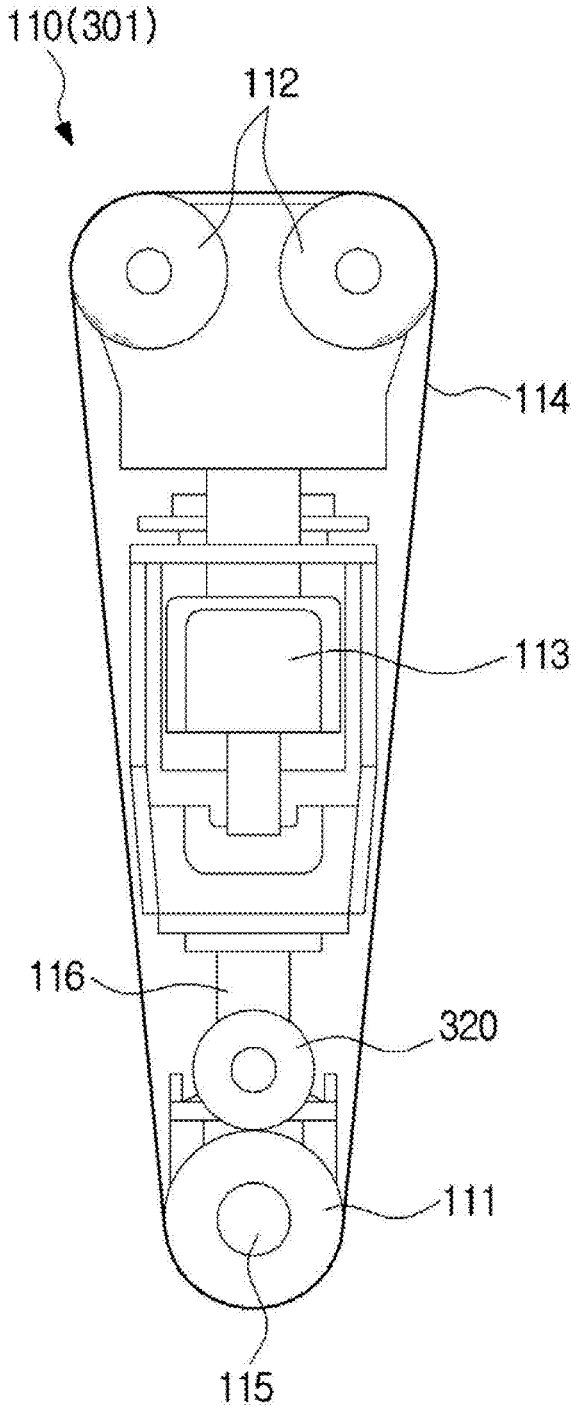
FIG. 12 shows a side of a hair-line processing head of an apparatus of manufacturing a panel for home appliance, according to another embodiment of the present disclosure.
Figure 13:
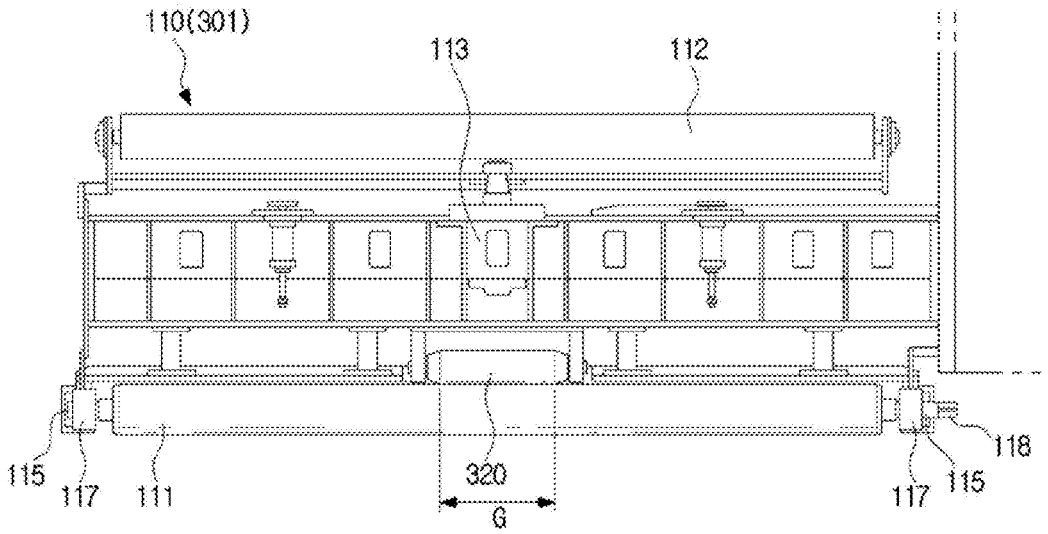
FIG. 13 shows a front portion of the hair-line processing head shown in FIG. 12.

FIG. 12 shows a side of a hair-line processing head of an apparatus of manufacturing a panel for home appliance, according to another embodiment of the present disclosure, and FIG. 13 shows a front portion of the hair-line processing head shown in FIG. 12.

Referring to FIGS. 12 and 13, a hair-line processing head 301 according to another embodiment of the present disclosure may include the bracket 117 in which the contacting roller 111 is installed, the connecting rod 116 connecting the tensioning cylinder 113 to the bracket 117, and the supporting roller 320 supporting the middle portion of the contacting roller 111. The bracket 117 may be supported on the tensioning cylinder 113 by the plurality of connecting rods 116. The supporting roller 320 may be supported on a lower surface of the tensioning cylinder 113. The contacting roller 111 may be connected to the bracket 117 such that both ends of the rotating shaft 115 are rotatable on the bracket 117. At one end of the rotating shaft 115 of the contacting roller 111, the driver connecting portion 118 may be provided.

The supporting roller 320 may have a length G that is shorter than the length of the contacting roller 111, and may be disposed at the center of the contacting roller 111. The contacting roller 111 of the hair-line processing head 301 may be connected to the bracket 117 at both ends of the rotating shaft 115. However, when the pressing roller 121 is pressed upward, the middle portion of the contacting roller 111 may be supported on the supporting roller 320. Accordingly, even when the contacting roller 111 has a long length D, the panel 20 can be pressed uniformly, and as a result, hair lines can be formed uniformly on the panel 20.

Figure 14:
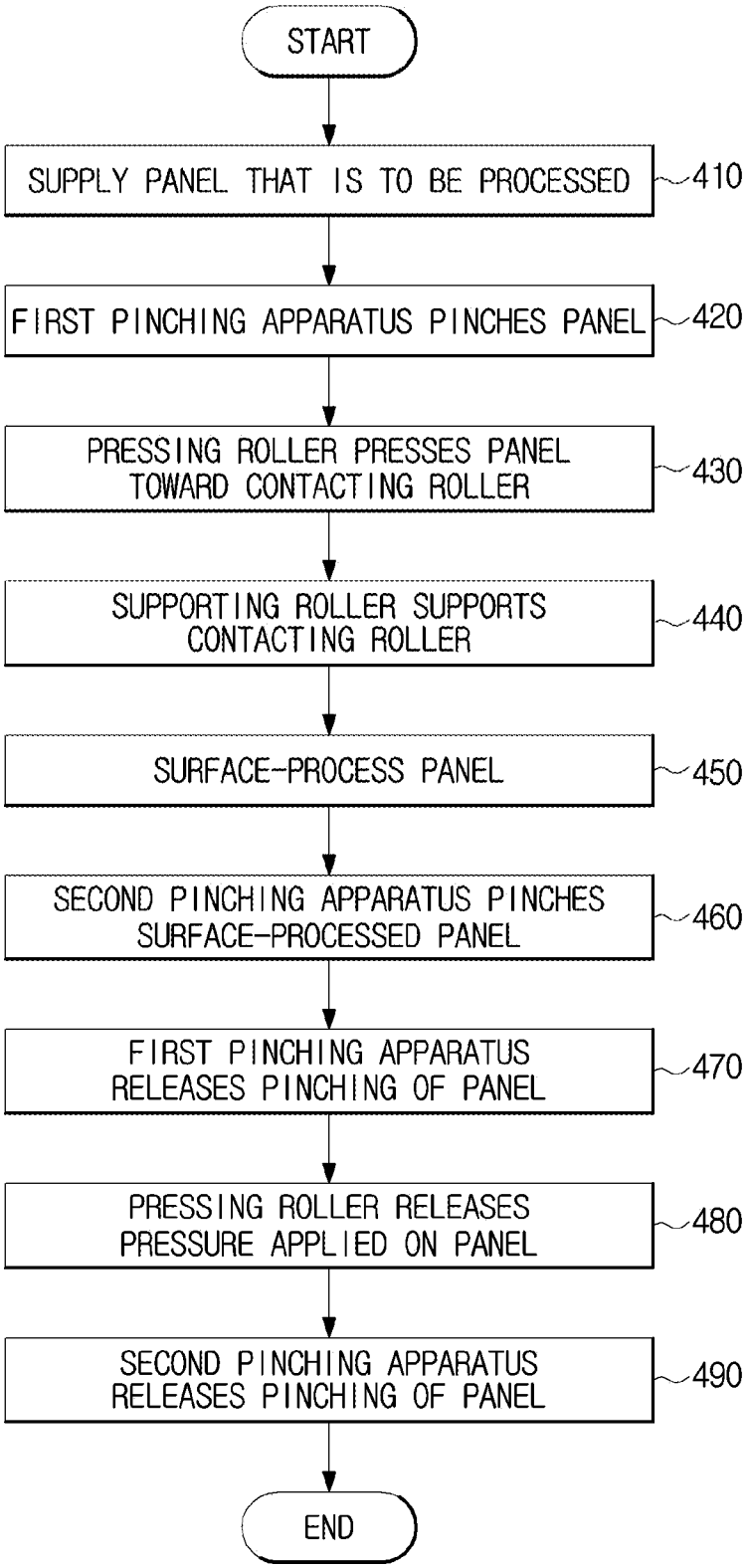
FIG. 14 is a flowchart illustrating a method of manufacturing a home appliance, according to an embodiment of the present disclosure.

FIG. 14 is a flowchart illustrating a method of manufacturing a home appliance, according to an embodiment of the present disclosure.

The method of manufacturing the home appliance, as shown in FIG. 14, may be applied to both a polishing method by the polishing apparatus 200 of the apparatus 10 of manufacturing the panel for home appliance, and a hair-line processing method by the hair-line processing apparatus 100, according to the embodiments of the present disclosure.

The method of manufacturing the home appliance, according to an embodiment of the present disclosure, may supply a panel that is to be processed to the polishing apparatus or the hair-line processing apparatus, in operation 410. The polishing apparatus or the hair-line processing apparatus may detect a position of the panel through a sensor.

A first pinching apparatus may include a first presser having a first upper pinching roller, and a first support having a first lower pinching roller. When the panel arrives at a position between the first upper pinching roller and the second lower pinching roller, the first pinching apparatus may lower the first upper pinching roller to pinch the panel, in operation 420.

The polishing apparatus or the hair-line processing apparatus may include a contacting roller for surface-processing the panel, and a pressing roller for pressing the panel toward the contacting roller. The pressing roller may be disposed below the contacting roller. If the panel pinched by the first pinching apparatus arrives at a position between the contacting roller and the pressing roller, the pressing roller may move upward by the pressing cylinder to press the panel toward the contacting roller, in operation 430.

A supporting roller disposed above the middle portion of the contacting roller may support the contacting roller so that the contacting roller can apply uniform pressure on the panel, in operation 440. Since the supporting roller distributes a force generated by the pressing of the pressing roller uniformly on the contacting roller, the contacting roller can surface-process the panel uniformly, in operation 450.

A second pinching apparatus disposed behind the contacting roller and the pressing roller may include a second presser having a second upper pinching roller, and a second supporter having a second lower pinching roller. If the surface-processed panel arrives at a position between the second upper pinching roller and the second lower pinching roller, the second pinching apparatus may lower the second upper pinching roller to pinch the panel, in operation 460.

The first pinching apparatus disposed in front of the contacting roller and the pressing roller may release pinching of the panel before the panel escapes from between the first upper pinching roller and the first lower pinching roller, in operation 470.

Also, before the panel being surface-processed by the contacting roller and the pressing roller escapes from between the contacting roller and the pressing roller, the pressing roller may release the pressure applied on the panel, in operation 480.

Finally, the second pinching apparatus disposed behind the contacting roller and the pressing roller may release pinching of the panel before the surface-processed panel escapes from between the second upper pinching roller and the second lower pinching roller, in operation 490.

Through the above-described operations, the method of manufacturing the home appliance can surface-process a panel for home appliance such that scratch patterns or hair line textures are formed uniformly on the panel.

According to one technical idea of the present disclosure, the apparatus of manufacturing the panel for home appliance can manufacture a panel for home appliance by uniformly processing the surface of the panel.

According to another technical idea of the present disclosure, the apparatus of manufacturing the home appliance can manufacture a home appliance including a panel whose surface is processed uniformly.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An apparatus for manufacturing a panel for a home appliance, comprising:

two brackets;

a contacting roller connected to the brackets such that both ends of the contacting roller are supported rotatably in a vertical direction, the contacting roller configured to perform surface-processing on a panel that is to be processed;

a pressing roller configured to press the panel toward the contacting roller;

a supporting roller supported on the brackets above the contacting roller and configured to support a middle portion of the contacting roller;

a belt having a rough surface to form hair-line textures or scratch patterns on the panel and configured to be pressed against the panel by the contacting roller;

a tensioning roller provided above the supporting roller to maintain a tension of the belt;

a tensioning cylinder configured to maintain spacing between the contacting roller and the tensioning roller; and a connecting rod provided between the brackets and connecting the tensioning cylinder to the brackets, wherein the belt is tensioned by the contacting roller and the tensioning roller, and is extended while maintaining the tension.

2. The apparatus according to claim 1, further comprising a plurality of supporting rollers arranged at regular intervals above the contacting roller.

3. The apparatus according to claim 1, further comprising a receiving roller disposed between the contacting roller and the supporting roller.

4. The apparatus according to claim 3, further comprising a plurality of receiving rollers.

5. The apparatus according to claim 3, wherein a length of the receiving roller is longer than or equal to a length of the contacting roller.

6. The apparatus according to claim 1, wherein the supporting roller has a length that is shorter than a length of the contacting roller, and is disposed at a center of the contacting roller.

7. The apparatus according to claim 1, wherein the pressing roller is disposed below the contacting roller, and presses the panel upward.

8. The apparatus according to claim 1, wherein the pressing roller presses the panel when the panel arrives at a position between the contacting roller and the pressing roller, and releases a pressure applied on the panel before the panel escapes from between the contacting roller and the pressing roller.

9. The apparatus according to claim 1, further comprising a pinching apparatus disposed in front of or behind the contacting roller and the pressing roller, and configured to pinch the panel, wherein the pinching apparatus comprises an upper pinching roller disposed above the panel, and a lower pinching roller disposed below the panel, and wherein the pinching apparatus pinches the panel when the panel arrives at a position between the upper pinching roller and the lower pinching roller, and releases the pinching of the panel before the panel escapes from between the upper pinching roller and the lower pinching roller.

10. The apparatus according to claim 9, wherein the pinching apparatus comprises a plurality of upper pinching rollers, and a plurality of lower pinching rollers corresponding to the plurality of upper pinching rollers.

* * * * *